US005820008A

United States Patent [19]

College

[11] Patent Number: 5,820,008

[45] Date of Patent: Oct. 13, 1998

[54] MACHINE FOR PROCESSING ELECTRICAL WIRES HAVING IMPROVED WIRE GUIDE

[75] Inventor: David A. College, Annville, Pa.

[73] Assignee: The Whitaker Corporation, Wilmington, Del.

[21] Appl. No.: 595,012

[22] Filed: Jan. 31, 1996

[51] Int. Cl.[6] ..... B65H 23/16; B65H 23/32

[52] U.S. Cl. ..... 226/34; 226/199

[58] Field of Search ..... 226/24, 34, 106, 226/112, 172, 178, 188, 189, 196, 199

[56] References Cited

U.S. PATENT DOCUMENTS

| | | | |
|---|---|---|---|
| 3,318,005 | 5/1967 | Petersen | 226/199 |
| 3,375,045 | 3/1968 | Zeidler | 226/199 |
| 4,228,939 | 10/1980 | Cattaneo | 226/172 |
| 4,277,011 | 7/1981 | Jeter | 226/199 |
| 4,426,046 | 1/1984 | Heuckroth | 226/199 |
| 4,437,601 | 3/1984 | Brooks | 226/199 |
| 4,510,981 | 4/1985 | Biller | 226/188 |
| 4,521,132 | 6/1985 | Isakson et al. | 226/188 |
| 4,984,728 | 1/1991 | Brinkmeier et al. | 226/172 |
| 5,370,290 | 12/1994 | Gilliland | 226/188 |
| 5,419,480 | 5/1995 | Pratt | 226/112 |
| 5,497,928 | 3/1996 | Burns et al. | 226/188 |

FOREIGN PATENT DOCUMENTS 0256364 of 1931 Italy ..... 226/199

*Primary Examiner*—Rodney H. Bonck
*Assistant Examiner*—Matthew A. Kaness
*Attorney, Agent, or Firm*—Marshall E. Rosenberg

[57] ABSTRACT

A machine (10) for processing electrical wires (80) during the manufacture of a product includes a wire feed mechanism (28) and a wire movement measuring mechanism (82). A wire guide apparatus (122) is disposed between the feed and measuring mechanisms to limit lateral movement of the wire (80). The wire guide apparatus (122) includes wire guiding surfaces (228, 248) that are adjustable to accommodate wires having different outside diameters within a range of diameters. The wire guide apparatus (122) includes a block (128), attached to the machine (10), having a fixed guide surface (200) and two opposed rails (132,134) in sliding engagement with the block. Each of the sliding rails (132, 134) includes a movable guide surface (228, 248) that cooperates with the fixed guide surface (200) to constrain lateral movement of the wire (80) during feeding. A manually operated eccentric mechanism (136, 146, 154) is coupled to the block (122) and arranged to move the rails (132, 134) and their respective movable guide surfaces (228, 248) toward or away from the fixed guide surface (200) to accommodate a specific wire diameter.

25 Claims, 8 Drawing Sheets

MACHINE FOR PROCESSING ELECTRICAL WIRES HAVING IMPROVED WIRE GUIDE

The present invention relates to wire processing machines having apparatus for selectively feeding a precise length of wire, and more particularly to such machines having wire guides that are adjustable to accommodate wires having different diameters.

BACKGROUND OF THE INVENTION

Machines that utilize wires in the manufacture of products typically draw the wire from a so called endless supply, such as a barrel or a reel. An example of a machine that utilizes wire in its manufacturing operation is one that produces wire leads for use in various electrical products or equipment. Such a machine, called a "lead maker" in the industry, feeds wire from an endless source, measuring its length precisely, then cutting it to a desired length. The ends may or may not be terminated to electrical terminals, or the ends may simply be prepared for termination. Such machines require some mechanism for accurately measuring feeding movement of the wire so that its length can be precisely established. These machines process wire at a rate of up to 450 inches per second and may impart acceleration to the wire of up to 3000 inches per second per second. Under these conditions the wire may tend to whip, or violently oscillate laterally. In order to accurately measure feeding movement the wire must be laterally confined very closely by wire guide members to prevent excessive excursions that may affect the accuracy of the measurement. These wire guides, typically, are blocks that are attached to the machine and have a hole through which the wire passes. The hole is slightly larger than the outside diameter of the wire so that the wire will pass through the hole with little interference yet be constrained to move along a well defined wire feed path.

When the machine is reconfigured to process wire of a different outside diameter these wire guide blocks must be removed and others having the appropriate size holes installed. This, of course, requires that wire guide blocks for each different size of wire be maintained in inventory, and further requires that the machine be taken out of production while the change is made.

What is needed is a wire guide mechanism that is easily adjustable for a range of different wire sizes. The adjustable wire guide would provide the necessary lateral constraint to the wire to assure accurate feed measurement and be easily adjustable by a worker that is relatively mechanically unskilled.

SUMMARY OF THE INVENTION

A machine is provided for processing electrical wires having a range of different outside diameters. Apparatus is provided for selectively feeding a precise length of the wire along a feed path. The apparatus includes a frame attached to the machine, a wire feed mechanism coupled to the frame, and a wire movement measuring mechanism, also coupled to the frame, for determining the precise length of wire being fed. A central wire guide is disposed along the wire path between a downstream side of the wire feed mechanism and an upstream side of the wire movement measuring mechanism. The central wire guide has wire guiding surfaces that are adjustable for closely receiving and guiding a wire having any specific outside diameter within the range of outside diameters. These guiding surfaces are arranged to closely constrain lateral movement of the wire so that feeding movement of the wire can be precisely measured.

DESCRIPTION OF THE PREFERRED EMBODIMENT

Figure 1:
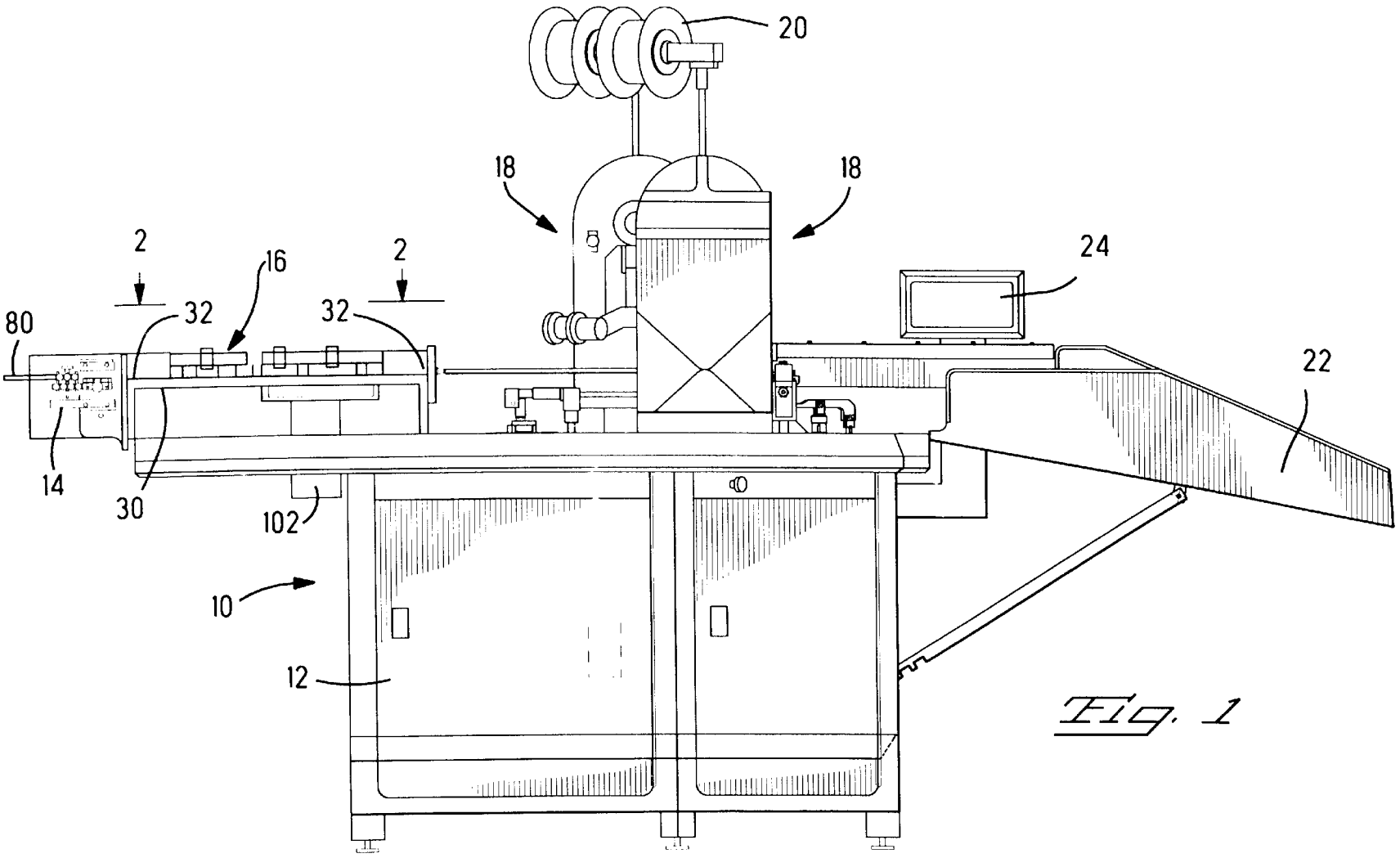
FIG. 1 is a front view of a wire lead making machine incorporating the teachings of the present invention.

There is shown in FIG. 1 a typical lead making machine 10 incorporating the teachings of the present invention. It will be understood that this machine is illustrative only and that the teachings of the present invention may be advantageously utilized with respect to other machines that utilize wire or cable in the manufacture of a product. The machine 10 includes a frame 12, a wire straightener 14, a wire feed assembly 16, two terminating units 18 including feed reels 20 containing carrier strips with attached terminals, a stacking tray 22, and an operator control counsel 24. The machine 10, as described above, is manufactured and distributed by AMP Incorporated under the trademark "AMPOMATOR CLS lll" and is well known in the industry.

Figure 2:
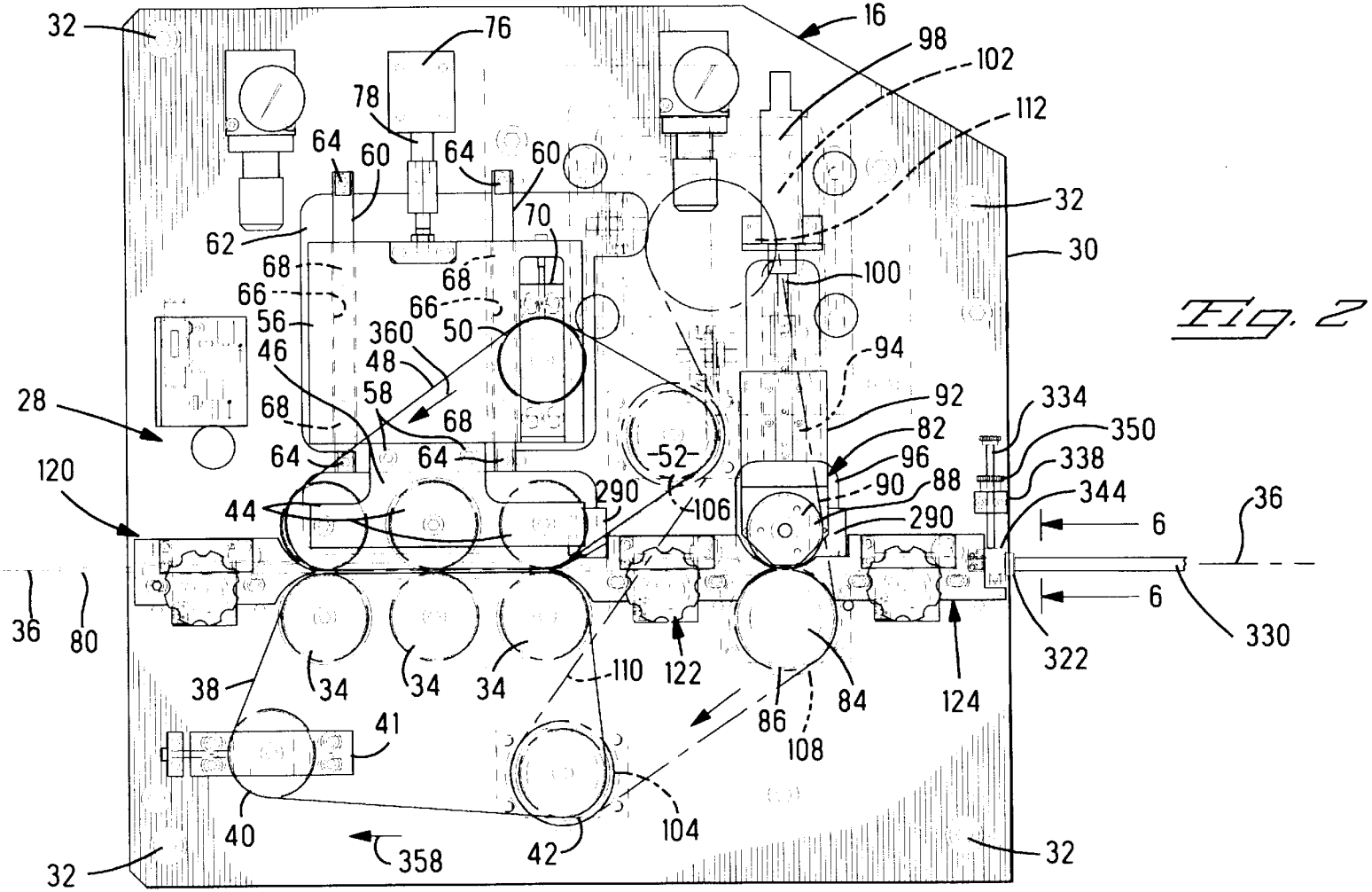
FIG. 2 is a view of a portion of the machine taken along the lines 2—2 in FIG. 1.

The wire feed assembly 16, as best seen in FIG. 2, includes a base plate, or frame 30 which is rigidly secured to the machine frame 12 by the screws 32. The assembly 16 includes a wire feed mechanism 28 having three feed pulleys 34 that are journaled for rotation on a post extending from the base plate 30 adjacent a wire feed path 36. A first wire feed belt 38 is disposed about the three pulleys 34, an idler pulley 40 and a driving pulley 42, as shown in FIG. 2. The idler pulley 40 is journaled for rotation in an adjustable member 41 that is coupled to the base plate 30. The member 41 can be adjusted horizontally, as viewed in FIG. 2, to set the tension of the feed belt 38, in the usual manner. Additionally, three feed pulleys 44 are journaled for rotation on posts extending from a T-shaped member 46, each pulley 44 being directly opposite a respective pulley 34, as shown. A second wire feed belt 48 is disposed about the three pulleys 44, an idler pulley 50, and a driving pulley 52, as shown in FIG. 2. The pulleys 34 and the pulleys 44 are arranged so that the portions of the first and second wire feed belts 38 and 48 traversing the pulleys are on opposite sides of the wire feed path 36. That is, the wire path 36 passes between the two belts 38 and 48. The T-shaped member 46 is attached to a movable slide member 56 by means of two screws 58. The member 56 is slidingly coupled to the base plate 30 by means of a pair of round rods 60 that span a recess 62 formed in the base plate 30 and are attached thereto at each end by means of the screws 64. The rods 60 extend through holes 66 formed through the movable slide member 56. The holes 66 includes bearing inserts 68 that are a slip fit with the rods so that the T-shaped member 46 and movable slide member 56 can easily slide toward and away from the wire path 36. The idler pulley 50 is journaled for rotation in an adjustable member 70 that is coupled to the movable slide member 56. The member 70 can be adjusted vertically, as viewed in FIG. 2, to set the tension of the feed belt 48, in the usual manner. An air cylinder 76 is attached to the base plate 30 and has its piston rod 78 coupled to the movable slide member 56 so that by actuation of the air cylinder the three pulleys 44 and belt 48 can be advanced toward the opposing pulleys 34 and belt 38. During feeding of a wire 80 along the wire path 36, a pressure of about 50 PSI is supplied to the air cylinder 76 to urge the feed belt 48 into feeding engagement with the wire so that the wire is sandwiched between the two feed belts 38 and 48.

A wire movement measuring mechanism 82 is coupled to the base plate 30 downstream from the feed rollers 38 and 48, as shown in FIG. 2. The mechanism 82 includes a capstan roller 84 having a polished outer surface 86, journaled for rotation in the plate 30 so that the surface 86 is adjacent the wire path 36. A measuring roller 88 is arranged directly opposite the capstan roller 84 and on the opposite side of the wire path 36.

The measuring roller 88 is attached to the input shaft of an encoder 90 that is attached to a carriage 92. The encoder produces an electrical signal that is indicative of the amount of movement of the wire and is used by the machine 10 to determine an accurate lead length in the usual manner. The carriage 92 is slidingly coupled to the base plate 30 by means of a commercially available ball slide member 94, so that the member 92, encoder 90, and measuring roller 88 can move toward and away from the capstan roller 84. An opening 96 is formed through the base plate for clearance for the encoder 90, as shown in FIG. 2. An air cylinder 98 is attached to the base plate 30 and has its piston rod 100 coupled to the carriage 92 so that when the air cylinder is pressurized the measuring roller 88 is urged into engagement with the wire 80, urging it against the polished surface 86 of the capstan roller 84. The feed belts 38 and 48 and the capstan roller 84 are driven by means of an electric motor 102 attached to the undersurface of the base plate 30, as shown in FIGS. 1 and 2. The shafts of the two idler pulleys 42 and 52 and the shaft of the capstan roller 84 extend through the base plate 30 and include drive pulleys 104, 106, and 108, respectively, attached thereto. A drive belt 110 is in driving engagement with these drive pulleys and in driven engagement with a pulley 112 that is attached to the drive shaft of the motor 102. The diameters of the drive pulleys 104, 106, and 108 and the diameter of the polished surface 86 are chosen so that the linear movement of the surface 86 is slightly faster than the movement of the feed belts 38 and 48 so that the surface 86 will slip a small amount against the outer surface of the wire 80 being fed along the wire path 36. This helps to assure that there is no slack in the wire between the feed belts and the measuring roller 88 and to provide a more accurate measurement of the amount of wire being fed.

The wire feed assembly 16 includes three wire guides to aid in confining and guiding the wire 36 during the feeding operation of the machine 10. As best seen in FIG. 2, there is an upstream wire guide 120, a central wire guide 122, and a downstream wire guide 124.

In the present example, the wire 36 is being fed from left to right, as viewed in FIG. 2. The three wire guides 120, 122, and 124, shown in FIGS. 3, 4, and 5, respectively, have similar adjusting mechanisms. Therefore, the central wire guide 122 will be described in detail followed by a description of the other two wire guides only with respect to their differences to the central wire guide.

Figure 3:
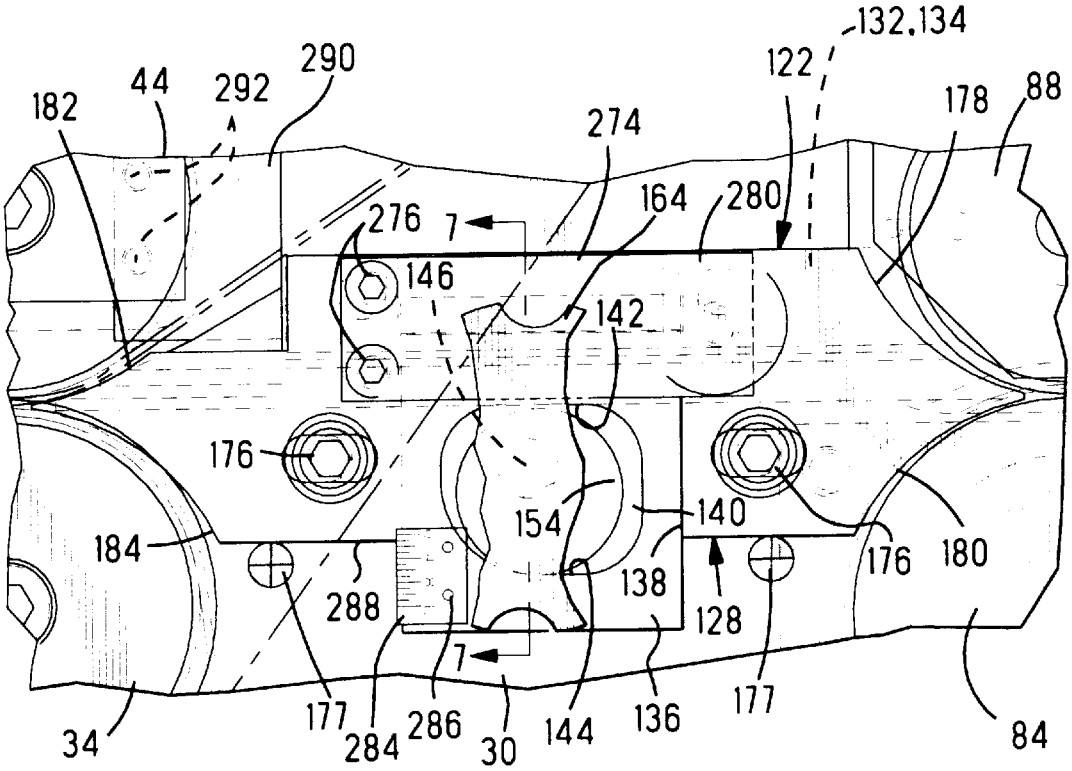
FIG. 3 is an enlarged plan view of the central wire guide mechanism shown in FIG. 2.
Figure 8:
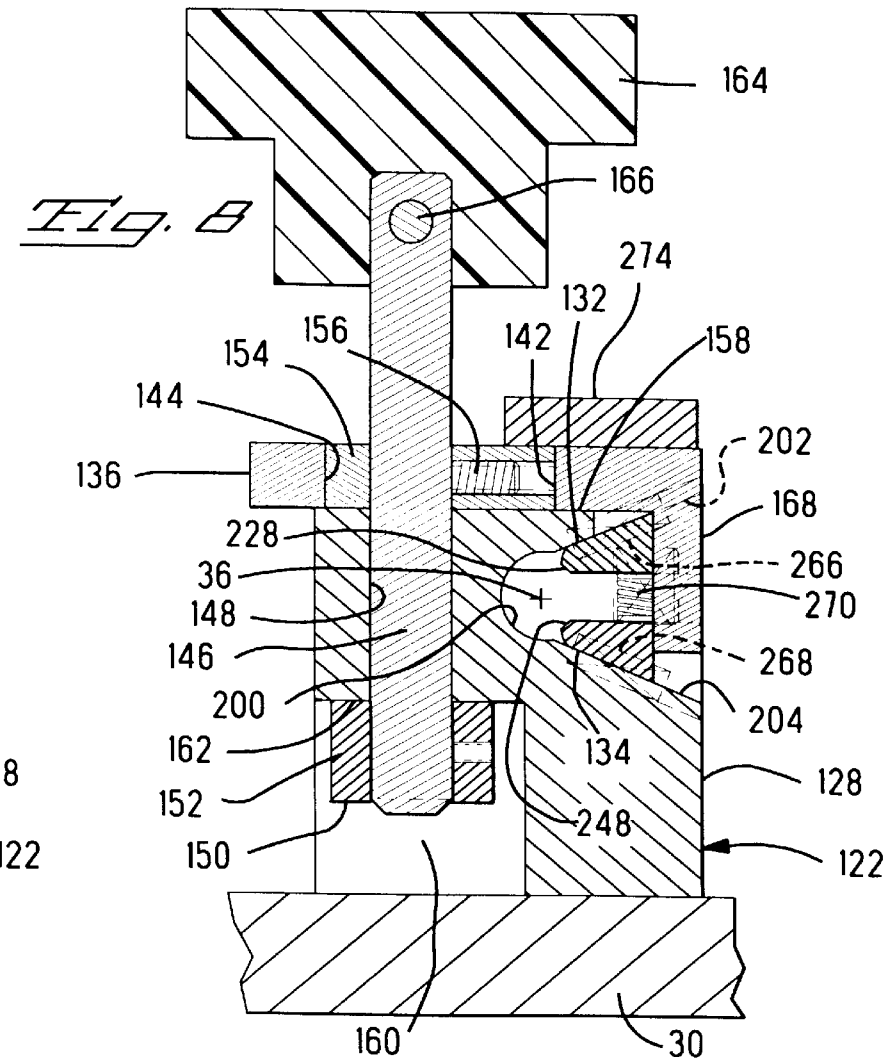
FIGS. 7 and 8 are cross-sectional views taken along the lines 7—7 of FIG. 3 showing the wire guide adjusting mechanism in two different operating positions.
Figure 7:
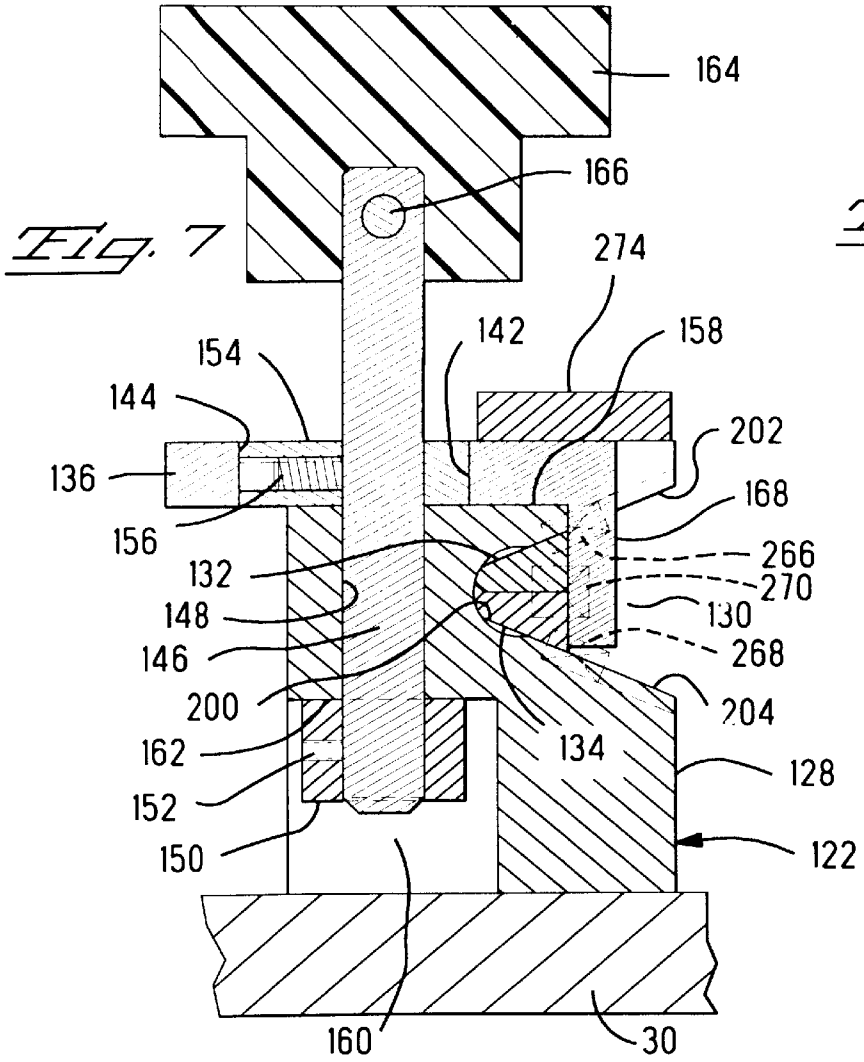

The central wire guide 122, as best seen in FIGS. 3, 7, and 8, includes a guide body 128 having a V-shaped opening 130, first and second elongated rails 132 and 134, respectively, that are disposed within the opening, and an L-shaped slide member 136 arranged in sliding engagement with a slot 138 formed in the top surface of the guide body 128. An opening 140 is formed through the L-shaped slide member 136, as best seen in FIG. 3, and includes first and second spaced parallel surfaces 142 and 144, respectively. A shaft 146 is journaled for rotation in a bore 148 formed in the guide body 128, as best seen in FIGS. 7 and 8, and is held in place by means of a collar 150 secured to one end thereof by a set screw 152 and a flat circular member 154 secured to the shaft 146 by a set screw 156. The circular member 154 rests upon the floor 158 of the slot 138 while the collar 150 is disposed within a counterbore 160 and is adjacent the floor 162 of the counterbore. The circular member 154 and collar 150 limit axial movement of the shaft 146 to a small amount for clearance purposes. The outside diameter of the circular member 154 is a close fit with the first and second parallel surfaces 142 and 144 and is eccentrically located with respect to the shaft 146. As the shaft is rotated, the eccentric circular member 154 rotates within the opening 140 and, bearing against either the first or second surfaces 142 or 144, causes the L-shaped slide member 136 to slide within the slot 138 either to the right, as viewed in FIG. 7, or to the left, as viewed in FIG. 8, depending upon the direction of rotation. When the shaft is rotated fully counterclockwise, the L-shaped slide member 136 is in the closed position shown in FIGS. 3 and 7. When the shaft is rotated fully counterclockwise, the L-shaped slide member 136 is in the open position shown in FIG. 8. A manually operable knob 164 is secured to the upper end of the shaft 146 by means of a pin 166 in the usual manner, for manually rotating the shaft. The L-shaped slide member 136 includes a leg 168 that extends into the V-shaped opening 130, as best seen in FIGS. 7 and 8, for a purpose that will be explained.

Figure 11:
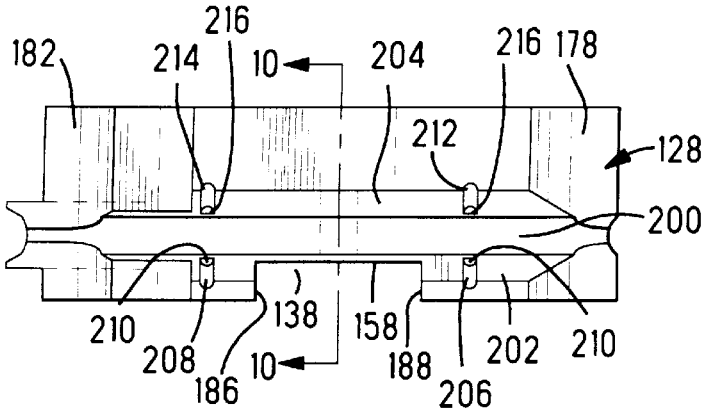
FIGS. 9, 10, and 11 are plan, end, and side views, respectively, of the central wire guide block shown in FIG. 3.
Figure 9:
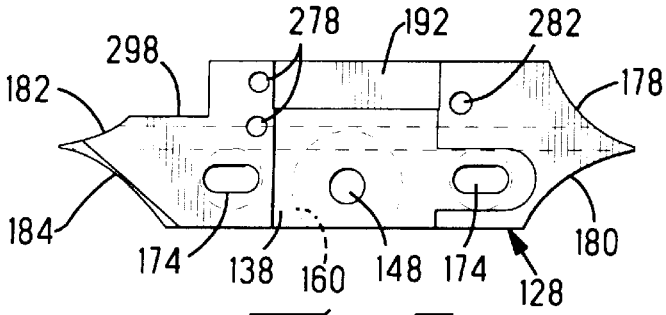
Figure 10:
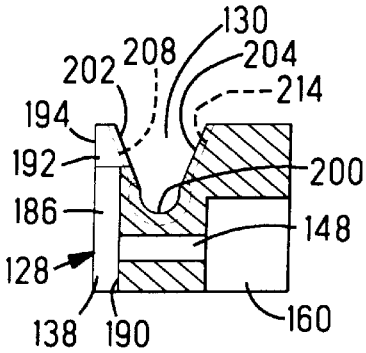

As shown in FIGS. 9, 10, and 11, the guide body 128 includes a pair of spaced elongated holes 174. A pair of screws 176 extend through these elongated holes and into threaded holes in the base plate 30 to secure the guide body 128 to the top surface of the base plate, as shown in FIG. 3. The elongated holes permit a small amount of side to side adjustment of the guide body 128 during initial assembly. A pair of pins 177 extend upwardly from the surface of the base plate 30 and are used to locate the guide body 128 during initial adjustment. The right end of the guide body 128, as viewed in FIGS. 3 and 9, includes two radiused surfaces 178 and 180 that provide clearance for the measuring roller 88 and the capstan roller 84, respectively. Similarly, the left end of the guide body 128 includes two radiused surfaces 182 and 184 that provide clearance for the feed pulley 44 and the feed pulley 34, respectively. The slot 138 includes two opposite side walls 186 and 188 extending from the floor 158 for slidingly receiving the L-shaped slide member 136. The slot 138 terminates in a clearance opening 192 that extends from the top surface 194 to the V-shaped opening 130, as best seen in FIGS. 9, 10, and 11. The opening 192 provides clearance for the leg 168 of the L-shaped slide member 136. The V-shaped opening 130 is a longitudinal opening extending the length of the guide body 128 and includes an arcuate fixed wire guiding surface 200 and first and second angled surfaces 202 and 204 diverging away from the surface 200, as best seen in FIG. 10. Two grooves 206 and 208 are formed in the first angled surface 202, each of which terminate in a floor 210. Similarly, two grooves 212 and 214 are formed in the second angles surface 204, each of which terminates in a floor 216. The purpose of the four grooves 206, 208, 212, and 214 will be explained below.

Figure 13:
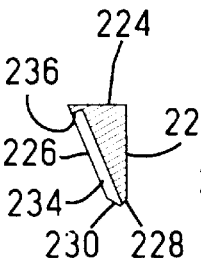
FIGS. 12 and 13 are plan and end views, respectively, of the upper guide rails.
Figure 12:
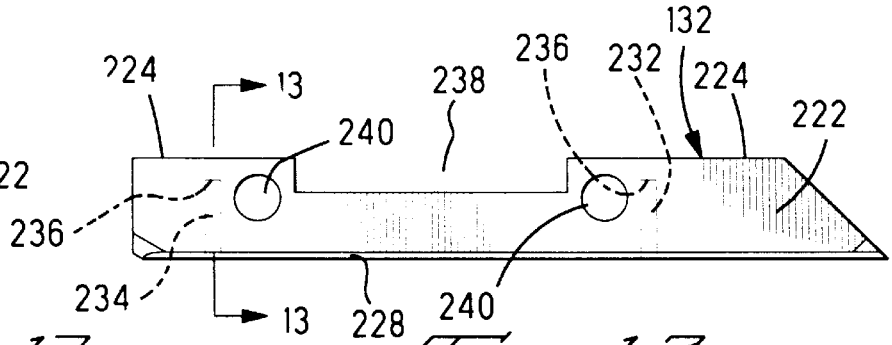
Figure 14:
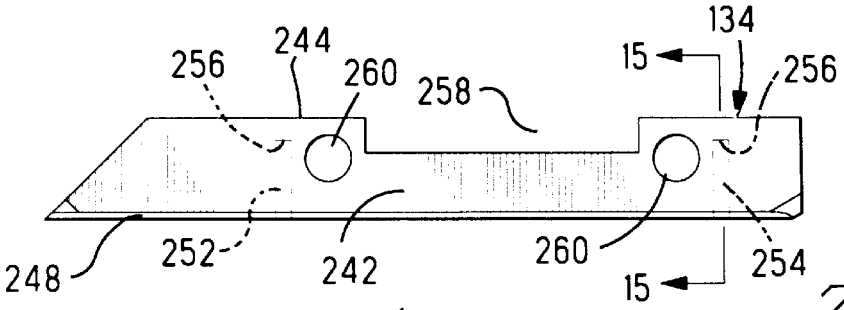
FIGS. 14 and 15 are plan and end views, respectively, of the lower guide rails.
Figure 15:
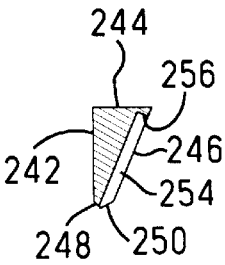

As shown in FIGS. 12 and 13, the first elongated rail 132 has a triangular cross section having a major flat surface 222, a side surface 224 that is at right angles thereto, and a third angled surface 226 that is in sliding engagement with the second angled surface 204 of the guide body 128, as shown in FIG. 7. The major surface 222 terminates in a first wire guiding surface 228, opposite the side surface, that extends along the entire length of the rail 132. A clearance chamfer 230 extends along the edge of the angled surface 226 adjacent the first wire guiding surface 228. A pair of grooves 232 and 234 are formed in the third angled surface 226, each of which terminates in a floor 236. Each of the two grooves 232 and 234 are opposed to and in alignment with a respective one of the grooves 206 and 208. A cutout 238 is formed in the surface 224 to receive, with clearance, the leg 168 of the L-shaped slide member 136. A pair of spaced blind holes 240 are formed in the major surface 222 on opposite sides of the cutout 238, as best seen in FIG. 12. The blind holes 240 extend into the surface 222 only a short distance for a purpose that will be explained. Similarly, as shown in FIGS. 14 and 15, the second elongated rail 134 has a triangular cross section having a major flat surface 242, a side surface 244 that is at right angles thereto, and a fourth angled surface 246 that is in sliding engagement with the first angled surface 202 of the guide body 128, as shown in FIG. 7. The major surface 242 terminates in a second wire guiding surface 248, opposite the side surface, that extends along the entire length of the rail 134. A clearance chamfer 250 extends along the edge of the angled surface 246 adjacent the second wire guiding surface 248. A pair of grooves 252 and 254 are formed in the fourth angled surface 246, each of which terminates in a floor 256. Each of the two grooves 252 and 254 are opposed to and in alignment with a respective one of the grooves 212 and 214. A cutout 258 is formed in the surface 244 to receive, with clearance, the leg 168 of the L-shaped slide member 136. A pair of spaced blind holes 260 are formed in the major surface 242 on opposite sides of the cutout 258, as best seen in FIG. 14. The blind holes 260 extend into the surface 242 only a short distance and are arranged so that each hole 260 of the second rail 134 is directly opposite and in alignment with a respective blind hole 240 of the first rail 132 when the first and second rails are in position within the opening 130 of the guide body 128, as shown in FIGS. 7 and 8.

A pair of compression springs 266 are arranged so that one spring is disposed within the opposing grooves 212 and 232 and the other spring is disposed within the opposing grooves 214 and 234. Similarly, a pair of compression springs 268 are arranged so that one spring is disposed within the opposing grooves 206 and 252 and the other spring is disposed within the opposing grooves 208 and 254. These springs tend to urge the first and second rails 132 and 134 outwardly away from the fixed wire guiding surface 200 and against the leg 168. A pair of compression springs 270 are arranged so that one spring is disposed within one set of opposing blind holes 240 and 260, and the other spring is disposed in the other set of opposing blind holes thereby urging the first and second rails 132 and 134 into sliding engagement with the angled surfaces 202 and 204, respectively. As the knob 164 is rotated to rotate the eccentric arranged circular member 154 from the closed position, shown in FIG. 7, to the open position shown in FIG. 8, the L-shaped slide member 136 is moved toward the right. As this movement occurs the compression springs 266, 268, and 270 cooperate to cause the first and second rails 132 and 134 to slide along the angled surfaces 202 and 204, respectively, so that the first and second wire guiding surfaces 228 and 248 move away from each other and away from the fixed wire guiding surface 200, the wire feed path 36 being equidistant between these three guiding surfaces. In this open position a wire having an outside diameter of 0.315 inch can be accommodated. As the knob 164 is rotated in the opposite direction to rotate the eccentric arranged circular member 154 from the open position, shown in FIG. 8, to the closed position shown in FIG. 7, the L-shaped slide member 136 is moved toward the left. As this movement occurs the springs 266, 268, and 270 are compressed as the first and second rails 132 and 134 slide along the angled surfaces 202 and 204, respectively, so that the first and second wire guiding surfaces 228 and 248 move toward each other and toward the fixed wire guiding surface 200, the wire feed path 36 again being equidistant between these three guiding surfaces. In this closed position a wire having an outside diameter of 0.035 inch can be accommodated. By adjusting the angular position of the eccentrically arranged circular member 154 within the opening 140, the first and second wire guiding surfaces 228 and 248 can be positioned with respect to the fixed wire guiding surface 200 to accommodate, in addition, any wire having an outside diameter between 0.035 inch and 0.315 inch. Therefore, the machine 10 can accommodate a range of wire diameters of from 0.035 inch through 0.315 inch.

After adjusting the L-shaped slide member 136 to position the first and second wire guiding surfaces for the desired wire diameter, the L-shaped slide member is locked in place by means of a clamp bar 274 having one end attached to the guide body 128 by means of screws 276 that are threaded into holes 278 in the guide body.

Figure 18:
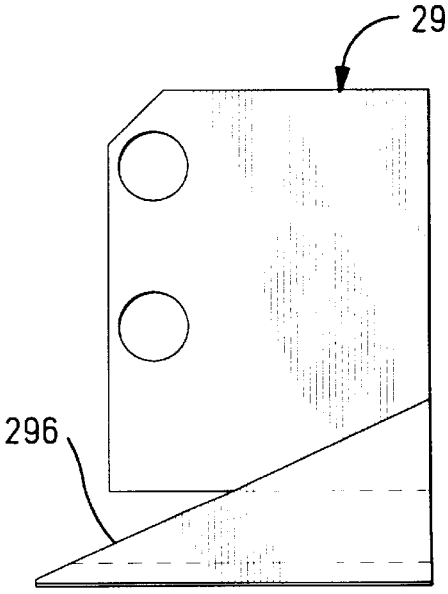
FIGS. 18 and 19 are plan and side views, respectively, of the wire deflector shown in FIG. 3.
Figure 19:
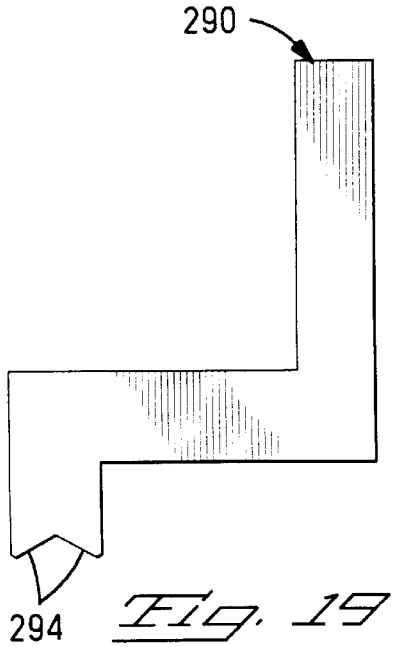

A thumb screw 280 extends through a clearance hole in the other end of the clamp bar 274 and into a threaded hole 282 formed in the guide body 128. The thumb screw 280, when tightened against the clamp bar, deflects the clamp bar against the L-shaped slide member 136 forcing it against the floor 158 thereby securing the slide member in place. An indicia plate 284 is attached to the L-shaped slide member 136 by means of the screws 286. The indicia are comparably aligned with the side 288 of the guide body 128 to aid in adjusting the mechanism for a desired diameter of wire. Optionally, a wire deflector 290 is attached to the T-shaped member 46 by means of screws 292, as shown in FIGS. 2 and 3, to aid in guiding a wire 80 after it emerges from between the two feed belts 38 and 48 and until it enters into the central wire guide 122. The wire deflector, as best seen in FIGS. 18 and 19, includes a V-shaped wire deflecting surface 294 and an angled surface 296 for clearance with the feed belt 48, as seen in FIG. 2. The guide body 128 includes a notch 298 at one end thereof that permits the V-shaped wire deflecting surface 294 to nestle in closely to the wire 80 and deflect it into the central wire guide 122. Since the wire deflector 290 is attached to the T-shaped member and is carried thereby, the V-shaped wire deflecting surface 294 is automatically properly positioned for each different diameter wire. This permits the wire 80 to be automatically threaded through the central wire guide 122 once the wire is in feeding engagement with the feed belts 38 and 48. Additionally, the angled surface 296 is always maintained clear of interference with the feed belt 48.

Figure 4:
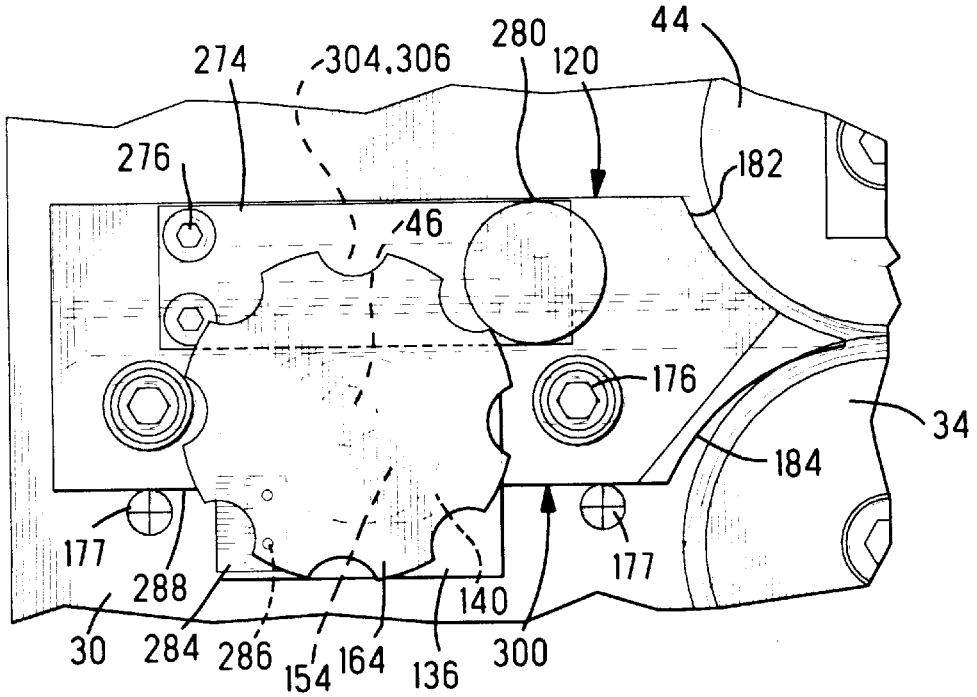
FIG. 4 is an enlarged plan view of the upstream wire guide mechanism shown in FIG. 2.
Figure 5:
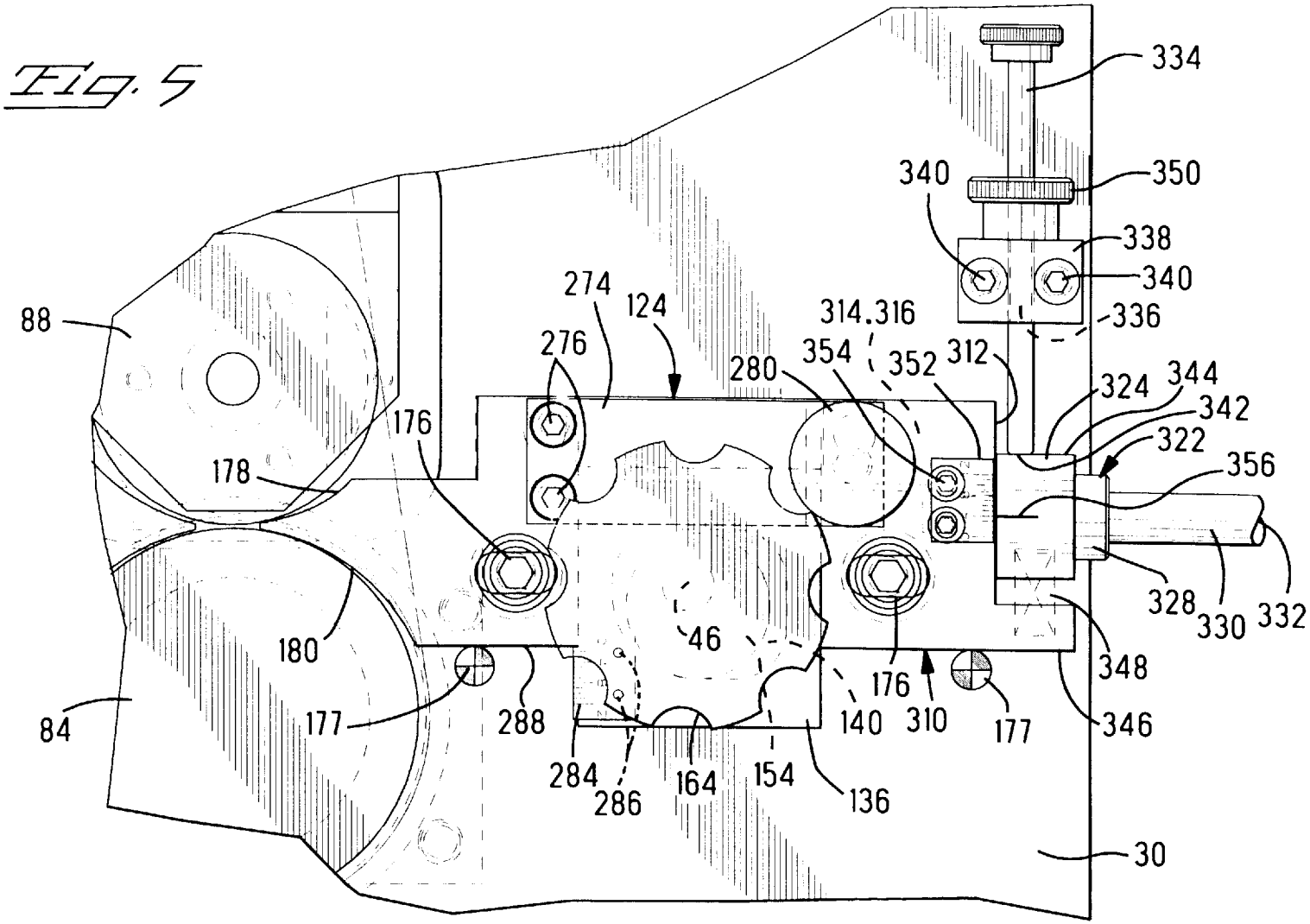
FIG. 5 is an enlarged plan view of the downstream wire guide mechanism shown in FIG. 2.

As set forth above the three wire guides 120, 122, and 124, shown in FIGS. 3, 4, and 5, respectively, have similar adjusting mechanisms. The central wire guide 122 was described in detail above. The other two wire guides 120 and 124 will now be described with respect to their differences to the central wire guide.

Figure 16:
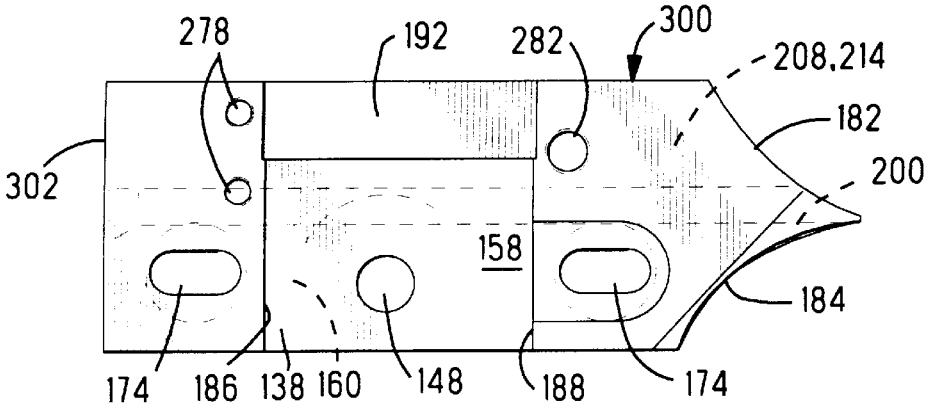

The upstream wire guide 120, shown in FIGS. 4 and 16, includes a guide body 300 having a squared off end 302 in place of the two radiused surfaces 182 and 184 which are arranged on the opposite end of the guide body 300 for clearance with the feed pulleys 44 and 34, respectively. Otherwise the guide body 300 is substantially identical to the guide body 128. The guide body 300 includes the V-shaped opening 130 with the fixed wire guiding surface 200 and angled surfaces 202 and 204, including the grooves 206, 208, 212, and 214, as described above for the guide body 128. A slot 138 and clearance opening 192 are formed in the guide body 300, as shown in FIG. 16, for slidingly receiving an L-shaped slide member 136, as shown in FIG. 4. The L-shaped slide member is adjustably movable by means of a knob 164, shaft 46, and eccentrically arranged circular member 154 disposed within an opening 140 in a manner similar to that of the central wire guide 122. Third and fourth elongated rails 304 and 306 are arranged within the opening 130 in sliding engagement with the angled surfaces 202 and 204 of the guide body 300. The rails 304 and 306 are similar to the first and second elongated rails 132 and 134, respectively, except that the rails 304 and 306 have lengths that correspond to the length of the guide body 300. The rails 304 and 306 include the wire guiding surfaces 228 and 248 and the angled surfaces 226 and 246, respectively, as well as the grooves 232, 234, 252, and 254, and the blind holes 260. The operation of the upstream wire guide 120 is identical to that of the central wire guide 122 when adjusting the position of the wire guiding surfaces to accommodate a desired diameter of wire.

Figure 17:
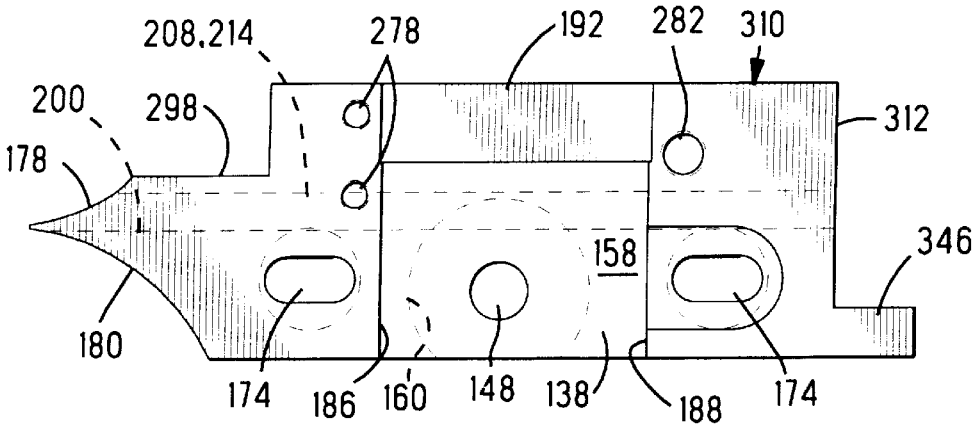
FIGS. 16 and 17 are plan views of the downstream and upstream wire guide blocks, respectively.

The downstream wire guide 124, shown in FIGS. 5 and 17, includes a guide body 310 having a squared off end 312 in place of the two radiused surfaces 178 and 180 which are arranged on the opposite end of the guide body 310 for clearance with the measurement roller 88 and capstan roller 84, respectively. Otherwise the guide body 310 is substantially identical to the guide body 128. The guide body 310 includes all of the features described above for the guide body 300 that are common with the guide body 128 and are identified with like numbers. Therefore, these common features will not be described again here. The downstream wire guide 124 includes fifth and sixth elongated rails 314 and 316 that are similar to the first and second elongated rails 132 and 134, respectively, except that the rails 314 and 316 have lengths that correspond to the length of the guide body 310. The operation of the downstream wire guide 124 is identical to that of the central wire guide 122 when adjusting the position of the wire guiding surfaces to accommodate a desired diameter of wire. The guide body 310 includes a notch 298, similar to that of the body 128, so that a wire deflector 290, as shown in FIG. 2, may be optionally utilized to aid in deflecting the wire 80 into the downstream wire guide 124, in a manner similar to that described above for the central wire guide 122.

Figure 6:
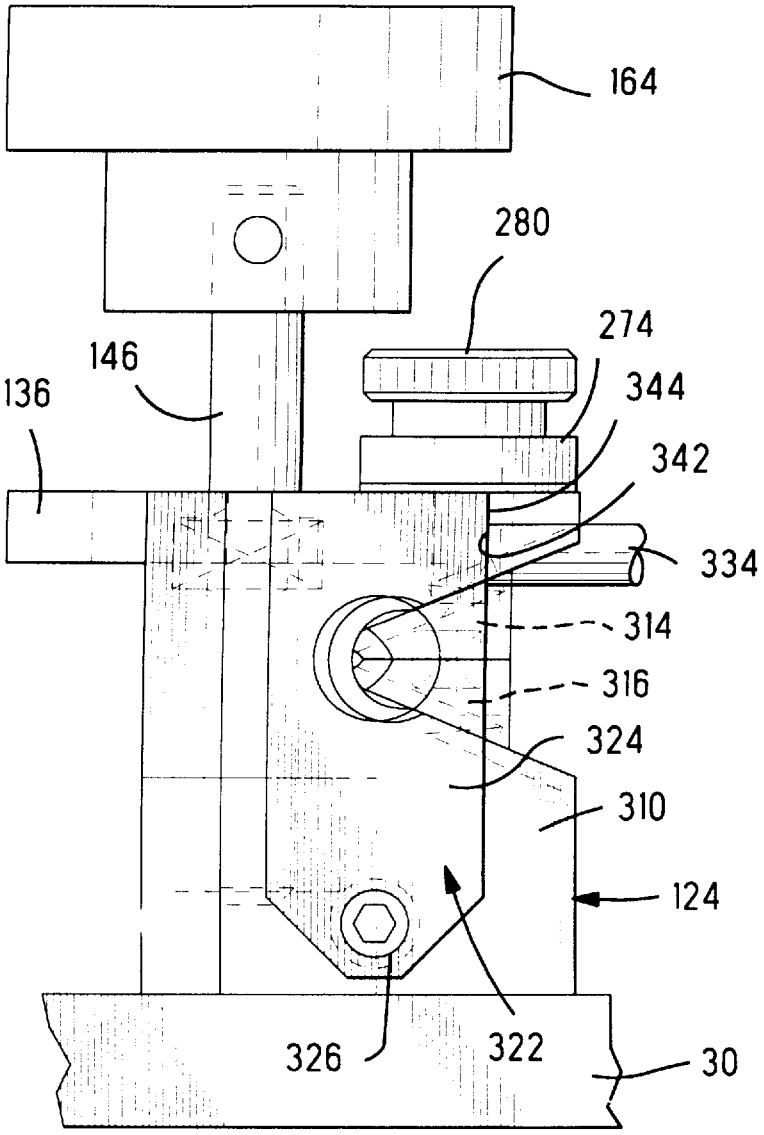
FIG. 6 is an end view of the right wire guide mechanism taken along the lines 6—6 of FIG. 2.

The downstream wire guide 124 includes an outlet wire guide 322, as best seen in FIGS. 5 and 6, for guiding the wire after leaving the wire feed assembly 16. The guide 322 includes an arm 324 that is pivotally attached to the guide body 310 by means of a shoulder screw 326. A bushing 328 having a flexible tube 330 extending therefrom is disposed a hole in the arm 324 and secured in place with a set screw. The bushing 328 and tube 330 have an inside diameter 332 that is larger than the largest diameter wire that can be processed by the wire feed assembly 16. Optionally, the inside diameter 332 may be of a smaller diameter when processing small or relatively limp wires that would otherwise tend to buckle within the larger diameter and possibly restrict movement of the wire or cause a complete jamb. In such cases the inside diameter 332 would be slightly larger than the diameter of the wire being processed. As the wire guides 120, 122, and 124 are adjusted to accommodate a different wire diameter, the outlet wire guide 322 must also be adjusted laterally with respect to the wire path so that the inside diameter 332 is in alignment with the wire being processed. This is accomplished by means of a jack screw 334 that is threaded through a hole 336 in a support block 338 which is attached to the base plate 30 by screws 340. One end 342 of the jack screw 334 abuts a side 344 of the arm 324 so that as the jack screw is threaded further into the support block 338 toward the arm, the end 342 causes the arm 324 to pivot counterclockwise, as viewed in FIG. 6. As shown in FIG. 5, a flange 346 extends from the end 312 of the block 310, adjacent a side of the arm 324 opposite the jack screw 334. A compression spring 348 is disposed between the flange 346 and the arm 324 for urging the arm against the end 342 of the jack screw. As the jack screw is threaded away from the arm 324, the arm will pivot clockwise under the urging of the spring 348. A thumb nut 350 is threaded onto the jack screw and is tightened against the support block 338 to lock the jack screw in a desired position. An indicia plate 352 is attached to the top surface of the guide body 310 adjacent the arm 344 by means of the screws 354. The indicia are aligned with a mark 356 on the top surface of the arm 344 to aid in adjusting the mechanism for a desired diameter of wire.

In operation, the upstream, central, and downstream wire guides 120, 122, and 124, respectively, are adjusted for the desired diameter of the wire 80, as described above. Additionally, the outlet wire guide 322 is positioned, as described above, so that the inside diameter 332 is in alignment with the wire 80 when the wire moves along the wire path 36. The wire 80 is manually fed into the upstream wire guide 120 until the end of the wire engages the two feed belts 38 and 48 which are moving in the directions indicated by the arrows 358 and 360, respectively, as shown in FIG. 2.

As the end of the wire is gripped between the two feed belts, the wire is pulled between the belts along the wire path 36 causing the movable slide member 56, the pulleys 44 and feed belt 48 assembly to move against the urging of the pressurized air cylinder 76 an amount sufficient to accommodate the wire, and into guided engagement with the central wire guide 122. The wire end emerges from the central wire guide 122 and engages the capstan roller 84 and measuring roller 88 and is pulled in between by the driven capstan roller causing the carriage 92 and measuring roller to move away from the capstan roller, against the urging of the pressurized air cylinder 98, a small amount to accommodate the wire 80. The capstan roller is arranged to rotate so that its outer surface 86 moves slightly faster than the wire 80 is being fed along the wire path 36. Since the surface 86 is polished, it will slip against the surface of the wire without causing damage to the wire, yet will provide enough feeding action to assure that the wire 80 remains straight and that the measuring roller 88 accurately indicates the actual movement of the wire. The end of the wire moves into guided engagement with the downstream wire guide 124. As feeding continues, the wire 80 emerges from the downstream wire guide, through the outlet wire guide 322, and into the flexible tube 330 for delivery to another operating element of the machine 10 such as the terminating units 18.

An important advantage of the present invention is that the wire guide mechanism is easily adjustable for a range of different wire sizes. This eliminates the requirement that wire guide blocks for each different size of wire be maintained in inventory, and further the requirement that the machine be taken out of production while the change is made. The adjustable wire guide will provide the necessary lateral constraint to the wire to assure accurate feed measurement and is easily adjusted by a relatively mechanically unskilled worker.

Additionally, the wire deflector permits automatic threading of the wire through the wire feed assembly once the wire is brought into engagement with the feed belts.

I claim:

1. In a machine for processing electrical wires having a range of different outside diameters, apparatus for selectively feeding a precise length of said wire along a wire feed path comprising:

(a) a frame attached to said machine;

(b) a wire feed mechanism coupled to said frame;

(c) a wire movement measuring mechanism coupled to said frame for determining said precise length; and (d) a wire guide disposed along said wire feed path having a fixed wire guiding surface fixed with respect to said frame and a movable wire guiding surface, said movable wire guiding surface being adjustably movable with respect to said fixed wire guiding surface for closely receiving and guiding said wire having any specific outside diameter within said range of outside diameters.

2. The machine according to claim 1 wherein said wire guide comprises:

(a) a body attached to said frame, said body having a longitudinal opening through which said wire feed path extends; and (b) first and second rails, having first and second said wire guiding surfaces, respectively, wherein said body includes said fixed wire guiding surface within said longitudinal opening and wherein said first and second rails are slidingly coupled to said body to slide toward and away from said wire feed path so that as said rails slide toward said wire feed path said first and second wire guiding surfaces move toward said fixed wire guiding surface and as said rails slide away from said wire feed path said first and second wire guiding surfaces move away from said fixed wire guiding surface.

3. The machine according to claim 2 wherein said longitudinal opening of said body contains first and second angled surfaces extending from opposite sides of said fixed wire guiding surface, said first rail being in sliding engagement with said first angled surface and said second rail being in sliding engagement with said second angled surface.

4. The machine according to claim 3 wherein said wire guide includes a slide member in sliding engagement with said body and arranged to slide in a first direction into abutting engagement with said first and second rails, thereby effecting said sliding of said first and second rails toward said wire feed path.

5. The machine according to claim 4 wherein said wire guide includes resilient means for urging said first and second rails into said abutting engagement with said slide member.

6. The machine according to claim 5 wherein said resilient means includes a first resilient member urging said first and second rails against said first and second angled surfaces, respectively, of said body, a second resilient member urging said first rail away from said wire feed path, and a third resilient member urging said second rail away from said wire feed path, so that when said slide member is moved in a second direction opposite said first direction said first and second rails slide away from said wire feed path.

7. The machine according to claim 6 wherein said wire guide includes a manually operable control for effecting said sliding of said slide member in said first and second directions.

8. The machine according to claim 7 wherein said control comprises a shaft journaled for rotation in said body and a camming member attached to said shaft in engagement with a surface of said slide member.

9. The machine according to claim 8 wherein said camming member is a circular member eccentrically attached to said shaft and said surface of said slide member comprises two opposing surfaces in engagement with said circular member.

10. The machine according to claim 9 wherein said wire guide includes a clamp attached to said body and arranged to secure said slide member against said body, thereby preventing said sliding movement of said slide member in said first and second directions.

11. The machine according to claim 2 including a wire deflector attached to said wire feed mechanism and arranged to deflect said wire exiting from said feed mechanism into said wire guide.

12. In a machine for processing electrical wires having a range of different outside diameters, apparatus for selectively feeding a precise length of said wire along a feed path comprising:

(a) a frame attached to said machine;

(b) a wire feed mechanism coupled to said frame;

(c) a wire movement measuring mechanism coupled to said frame for determining said precise length; and (d) three wire guides disposed along said wire feed path, each wire guide having a fixed wire guiding surface fixed with respect to said frame and a movable wire guiding surface, said movable wire guiding surface being adjustable movable with respect to said fixed wire guiding surface for closely receiving and guiding said wire having any specific outside diameter within said range of outside diameters, said three wire guides comprising:

an upstream wire guide disposed along said wire feed path adjacent an upstream side of said wire feed mechanism;

a central wire guide disposed along said wire feed path between a downstream side of said wire feed mechanism and an upstream side of said wire movement measuring mechanism; and a downstream wire guide disposed along said wire feed path adjacent a downstream side of said wire movement measuring mechanism.

13. The machine according to claim 12 wherein each of said upstream, central, and downstream wire guides comprises:

(a) a body attached to said frame, said body having a longitudinal opening through which said wire feed path extends; and (b) first and second rails, having first and second said wire guiding surfaces, respectively, wherein said body includes said fixed wire guiding surface within said longitudinal opening and wherein said first and second rails are slidingly coupled to said body to slide toward and away from said wire feed path so that as said rails slide toward said wire feed path said first and second wire guiding surfaces move toward said fixed wire guiding surface and as said rails slide away from said wire feed path said first and second wire guiding surfaces move away from said fixed wire guiding surface.

14. The machine according to claim 13 wherein said longitudinal opening of each said body contains first and second angled surfaces extending from opposite sides of said fixed wire guiding surface, said first rail being in sliding engagement with said first angled surface and said second rail being in sliding engagement with said second angled surface.

15. The machine according to claim 14 wherein each said wire guide includes a slide member in sliding engagement with said body and arranged to slide in a first direction into abutting engagement with said first and second rails, thereby effecting said sliding of said first and second rails toward said wire feed path.

16. The machine according to claim 15 wherein each said wire guide includes resilient means for urging said first and second rails into said abutting engagement with said slide member.

17. The machine according to claim 16 wherein said resilient means for each said wire guide includes a first resilient member urging said first and second rails against said first and second angled surfaces, respectively, of said body thereof, a second resilient member urging said first rail away from said wire feed path, and a third resilient member urging said second rail away from said wire feed path, so that when said slide member is moved in a second direction opposite said first direction said first and second rails slide away from said wire feed path.

18. The machine according to claim 17 wherein each said wire guide includes a manually operable control for effecting said sliding of said slide member in said first and second directions.

19. The machine according to claim 18 wherein said control of each said wire guide comprises a shaft journaled for rotation in said body and a camming member attached to said shaft in engagement with a surface of said slide member.

20. The machine according to claim 19 wherein each said camming member is a circular member eccentrically attached to its respective said shaft and said surface of each respective said slide member comprises two opposing surfaces in engagement with said circular member.

21. The machine according to claim 20 wherein each said wire guide includes a clamp attached to said body and arranged to secure said slide member against said body, thereby preventing said sliding movement of said slide member in said first and second directions.

22. The machine according to claim 12 including a wire deflector attached to said wire feed mechanism and arranged to deflect said wire exiting from said feed mechanism into said central wire guide.

23. The machine according to claim 12 including a wire deflector attached to said wire movement measuring mechanism and arranged to deflect said wire exiting from said wire movement measuring mechanism into said downstream wire guide.

24. The machine according to claim 12 including an outlet wire guide coupled to said frame and arranged to receive said wire from said downstream wire guide and deliver said wire to another operating element of said machine.

25. The machine according to claim 24 wherein said outlet wire guide is laterally adjustable with respect to said wire feed path for alignment with any diameter of said wire within said range of diameters.

* * * * *